US005902069A

United States Patent [19]

Barth et al.

[11] Patent Number: 5,902,069

[45] Date of Patent: May 11, 1999

[54] ARTIFICIAL PAVING STONE WITH IDENTICAL SPACER ELEMENTS HAVING A TOOTH AND A TOOTH RECESS

[75] Inventors: Gunter Barth, Buhlertal; Michael Schmitz, Weitenung, both of Germany

[73] Assignee: F. Von Langsdorff Licensing Limited, Inglewood, Canada

[21] Appl. No.: 08/803,385

[22] Filed: Feb. 20, 1997

[30] Foreign Application Priority Data

Feb. 20, 1996 [DE] Germany ..... 296 02 972 U

[51] Int. Cl.[6] ..... E01C 5/00

[52] U.S. Cl. ..... 404/34; 404/37; 404/41; 404/38; 52/596; 52/603

[58] Field of Search ..... 404/34, 37, 38, 404/39, 40, 41; 52/596, 311.1, 603, 604, 605

[56] References Cited

U.S. PATENT DOCUMENTS

| | | | |
|---|---|---|---|
| 1,058,674 | 4/1913 | Kertes | 404/38 X |
| 1,884,216 | 10/1932 | Purdy | 404/40 X |
| 2,060,746 | 11/1936 | Porter | 404/38 |
| 5,409,325 | 4/1995 | Wu | 404/41 X |
| 5,466,089 | 11/1995 | Jurik | 404/37 X |
| 5,503,498 | 4/1996 | Scheiwiller | 404/34 |

FOREIGN PATENT DOCUMENTS

| | | | |
|---|---|---|---|
| 377460 | 7/1990 | European Pat. Off. | 404/40 |
| 406306806 | 11/1994 | Japan | 404/40 |
| 509240 | 7/1939 | United Kingdom | 404/34 |

*Primary Examiner*—Tamara L. Graysay
*Assistant Examiner*—Jong-Suk Lee
*Attorney, Agent, or Firm*—Orrick, Herrington & Sutcliffe LLP

[57] ABSTRACT

There is provided an artificial stone for strengthening traffic surfaces in the open, in which the stone, in order to provide wide grooves between adjacently laid stones, is provided on its edge surfaces with integrally formed, completely identical spacer elements, the contacting free end surfaces of the spacer elements having, adjacent one another, a tooth and a recessed contact surface for the tooth of the adjacently laid stone; the tooth-recess sequence, in one peripheral direction of the stone, being the same for all spacer elements; the effective length of the individual edge surfaces of a stone, parallel to the laying plane, being the same as, or a whole-number multiple of, a smallest effective length; each edge surface segment which has the smallest effective length being provided with a spacer element; and the central axes of all spacer elements lying in the middle of the corresponding edge surface segment. The contact surface is formed as a tooth recess corresponding to the size of the tooth and enclosing the latter on both sides in the direction parallel to the laying plane and to the corresponding edge surface. The flanks of thee tooth and of the tooth recess enclose an angle of at least 90 degrees, and the bisector of the angle is essentially parallel to a perpendicular drawn to the corresponding edge surface.

12 Claims, 7 Drawing Sheets

ARTIFICIAL PAVING STONE WITH IDENTICAL SPACER ELEMENTS HAVING A TOOTH AND A TOOTH RECESS

SUMMARY OF INVENTION

The invention relates to an artificial stone, particularly one made of concrete, for the strengthening of traffic-bearing surfaces in the open, in which the stone, in order to provide wide grooves between adjacently laid stones, is provided on at least two of its edge surfaces disposed perpendicular to the laying plane, and extending substantially parallel to one another, with integrally formed, completely identical spacer elements, the contacting free end surfaces of the spacer elements having, in the direction of the laying plane and of the mutually facing edge surface, a tooth and a recessed contact surface for the tooth of the adjacently-laid stones; the tooth-recess sequence, in one peripheral direction of the stone, being the same for all spacer elements; the effective length of the individual edge surfaces of a stone, parallel to the laying plane, being the same as, or a whole-number multiple of, a smallest effective length; each edge surface segment which has the smallest effective length being provided with a spacer element; and the central axis lying between the tooth and the contact surface, parallel to the laying plane and perpendicular to the corresponding edge surface, being positioned in the middle of the corresponding edge surface segment.

Such artificial stones, which should be considered to also include flagstones, particularly made of concrete, can have either a complete, closed surface or a structured surface. Also contemplated are stones or flagstones with openings therethrough, for example the so-called grass-lattice stones, in which the openings can be filled with earth and sown with grass seed, in order to provide a nature-like appearance to the surface containing the stones.

In order to provide, between neighboring stones, a wide groove for filling with a mineral mixture or earth and for grass seed, the stones of the above-described kind are provided with spacer elements which determine the width of the groove by how far they project perpendicular to the facing side edges.

The grooves, and optionally also the openings of the stones, further serve to absorb surface water, so that for surfaces which are covered with stones of the kind in question, drainage is either not required or much reduced.

By virtue of the fact that all spacer elements have the same configuration and function, the task of laying the stones no longer requires special attention. Instead, the stones can be set against already laid stones in whatever orientation they have when the worker takes them in hand, thus avoiding the expenditure of time and effort required to determine the particular type of spacer projecting from the stones already laid, in order then to correctly position, by rotation, the next stone to be laid. Taken altogether, the time expenditure required for the work of laying the stones is greatly reduced. Further, there is no longer any limitation as to bracing materials to be laid.

The size determination of the stones is such that the dimension of stones particularly intended for a laying pattern is normally equal to or a multiple of a smallest basic dimension. With this smallest basic dimension, the effective edge length is the edge length of the stone as such, plus two times one-half of the groove adjacent the edge and extending in its longitudinal direction, the size or width of the groove being determined on the basis of the effective size, relative to the neighboring stone, of the spacer element provided.

However, if a stone in one longitudinal direction is (for example) triple the basic size, then, seen in this same longitudinal direction, the middle longitudinal segment of the stone as such corresponds to the effective length of the basic size, whereas the longitudinal segments that are located adjacently on either side of the middle segment of the edge, correspond to a longitudinal segment of the stone as such plus half the width of the adjacent groove extending in this longitudinal direction.

For a stone configuration of this kind, if the spacer elements are arranged in the manner described initially, then neighboring stones will always fit together in accordance with the pattern established by the basic size, whereby this pattern also determines the accuracy of the displacement between neighboring stones. The finer the step distance is desired to be, the smaller is the basic size of the pattern that is selected, in order to have available a sufficient number of adjacently positioned spacer elements for the displacement of adjacent stones, when the stones are of a given size.

With known stones of the kind described earlier in detail, however, the spacer elements of adjacently laid stones achieve a complementary interlock, in the direction of the laying plane and the facing edge surfaces, only through the mutually facing flanks of adjacently positioned teeth, leading to an interconnection which is, correspondingly, effective only in one direction. The result is a covering which, in terms of its solidity parallel to the laying plane, cannot resist all of the loads that typically arise, in that the individual stones can be mutually displaced in the direction opposite that of the above-mentioned interlock, or may possibly undergo rotation within the connected structure. At particularly stressed locations in the covering layer, this movement possibility can result in stones coming into contact due to gradual rotation, with the resulting risk of damage to the covering layer. Such particularly stressed locations, for example, occur especially where the steering of heavy vehicles is activated at low speeds, or even when stationary. This disadvantage of known stones is accepted apparently with a view to making possible the unhindered displaceability of the stones, even in the comers of an angularly laid portion of a covering layer.

In light of the above, an object of the invention is to configure an artificial stone of the kind described initially, such that its opposed connection with adjacent stones is secure in both directions parallel with the edge surfaces, and yet it can be displaced with respect to stones already laid, by undergoing essentially horizontal movement.

In accordance with the invention, the foregoing object is attained in that the contact surfaces are constructed as tooth recesses corresponding to the size of the teeth and enclosing the teeth on both sides in the direction parallel to the laying plane and the corresponding edge surface; in that the tooth flanks disposed in the mentioned direction, and also the recess flanks, enclose an angle of at least 90 degrees; and in that the bisector of this angle is disposed essentially parallel with a perpendicular drawn to the corresponding edge surface.

The latter provision in accordance with the invention ensures that the teeth are braced, parallel to the laying plane and the particular edge surface, by the corresponding tooth recess, so that a given stone, subjected to horizontal forces parallel to the groove direction, can no longer shift out of the pattern established with adjacent stones due to displacement or to rotation about an axis perpendicular to the laying plane. In this manner, the stability of the covering layer made with the help of artificial stones in accordance with the invention is attained not only with respect to loads arising from traffic moving in a straight line but also with respect to the kind of extreme loads which are applied to the stones by a turning movement about an axis perpendicular to the laying plane.

On the other hand, however, the stones can still be laid in the normal way, since the shape of the angle in accordance with the invention allows the stones to be laid, using an essentially horizontal movement, even in the comer of a previously laid angle defined by adjacent stones.

Within the framework of the invention, it is advantageous for the tooth flanks and those of the tooth recess to enclose an angle of 90 degrees, since this maximizes the mutual connection with adjacently laid stones, and maximizes the stability of the layer created with theses stones. The flanks of the tooth and of the tooth recess can be rectilinear, permitting a simple construction. However, there is also the possibility of providing the flanks of the tooth and the tooth recess with a contour other than that of a flat plane, for example a curvilinear one. The only important factor is that the central slopes of the flanks enclose an angle of at least 90°. Of course, only such flank configurations can be used which do not interfere with stone movability.

As to the configuration of the end surface of the spacer elements, it can be provided that the end surface of the tooth and of the corresponding tooth recess of the spacer element-parallel to the laying plane—has the configuration of an acute-angled truncated cone or a curve.

It is further of advantage for the spacer elements to lie below the upper surface of the stone which faces away from the laying plane. In this way, following the laying of the stones, there will be enough space above the spacer elements for the packing of earth, thus creating uninterrupted channels between adjacent stones.

As to the stones themselves, these can exhibit a cross-section, parallel to the laying plane, which is square, rectangular, hexagonal, L-shaped, Z-shaped, T-shaped or double-T-shaped.

In particular for large-surface stones, it can be advantageous, as an extension of the inventive concept, to divide the stone by providing at least one wide channel, in which the resulting parts of the stone are connected to each other by solidly connected common bridges, wherein the arrangement of such bridges corresponds to that of the spacer elements. Thus, in this connection a larger stone can give the impression of a unit which is assembled together from smaller individual stones of different sizes, in accordance with the desired pattern, however without the necessity of individually laying a corresponding number of smaller individual stones.

Finally, it is contemplated that the stone can be connected together with other stones of the same or different size to form a laying unit, so as to give the possibility of being laid with mechanical devices.

BRIEF DESCRIPTION OF THE DRAWINGS

Further inventive characteristics and details are set forth in the following description of example embodiments, which are illustrated in the drawings. In the drawings, there is illustrated.

DETAILED DESCRIPTION

Figure 1:
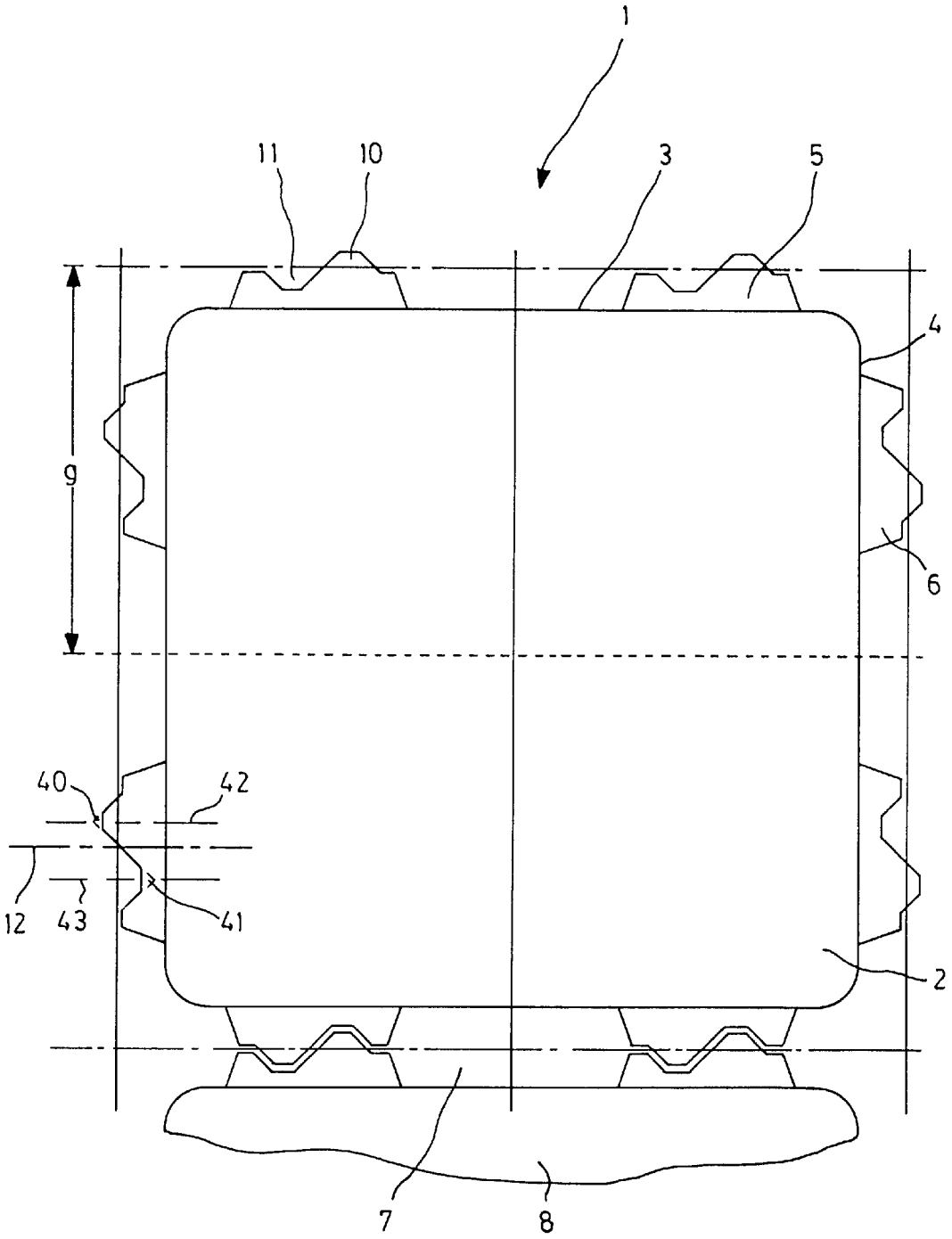
In FIG. 1 a square stone with spacers constructed in accordance with the invention.

FIG. 1 shows a square stone 1, which, in accordance with the illustrated centre lines, is the equivalent of four basic size units 2. The edge surfaces 3,4 of each basic size unit 2 support a spacer element 5,6. Due to the presence of these spacer elements, the effective length of each basic size unit 2 in the present case amounts to the edge length 3 or 4, plus half the width of the channel 7 leading to an adjacent stone 8, and thus amounts to the dimension shown by the numeral 9.

The end surfaces of the spacers 5,6 exhibit, next to each other, a tooth 10 and a tooth recess 11 corresponding thereto, in which, seen in one peripheral direction around the stone 1, the teeth 10 and the recesses 11 of all spacer elements 5,6 follow each other in the same order. By this means, the end surfaces of the spacer elements of adjacent stones 1,8 interlock with one another, such that the stones parallel to the plane of the drawing, and the mutually facing edge surfaces, cannot be shoved against each other.

In addition, the position of the spacer elements 5,6 is the same with reference to all effective lengths 9 and so arranged that the central axis 12 of all spacer elements lies in the middle of the effective length 9.

The flanks of both the teeth 10 and the tooth recesses 11 enclose corresponding angles 40,41, having a size of at least 90 degrees but preferably being 90 degrees, the bisector 42,43 of which is essentially parallel to a line perpendicular to the corresponding edge surface of the stone, which line may be considered to be represented by the central axis 12 for the same edge surface of the stone. This configurational characteristic applies also the embodiments described with reference to FIGS. 2 to 8, without having to be repeated for each instance.

Figure 2:
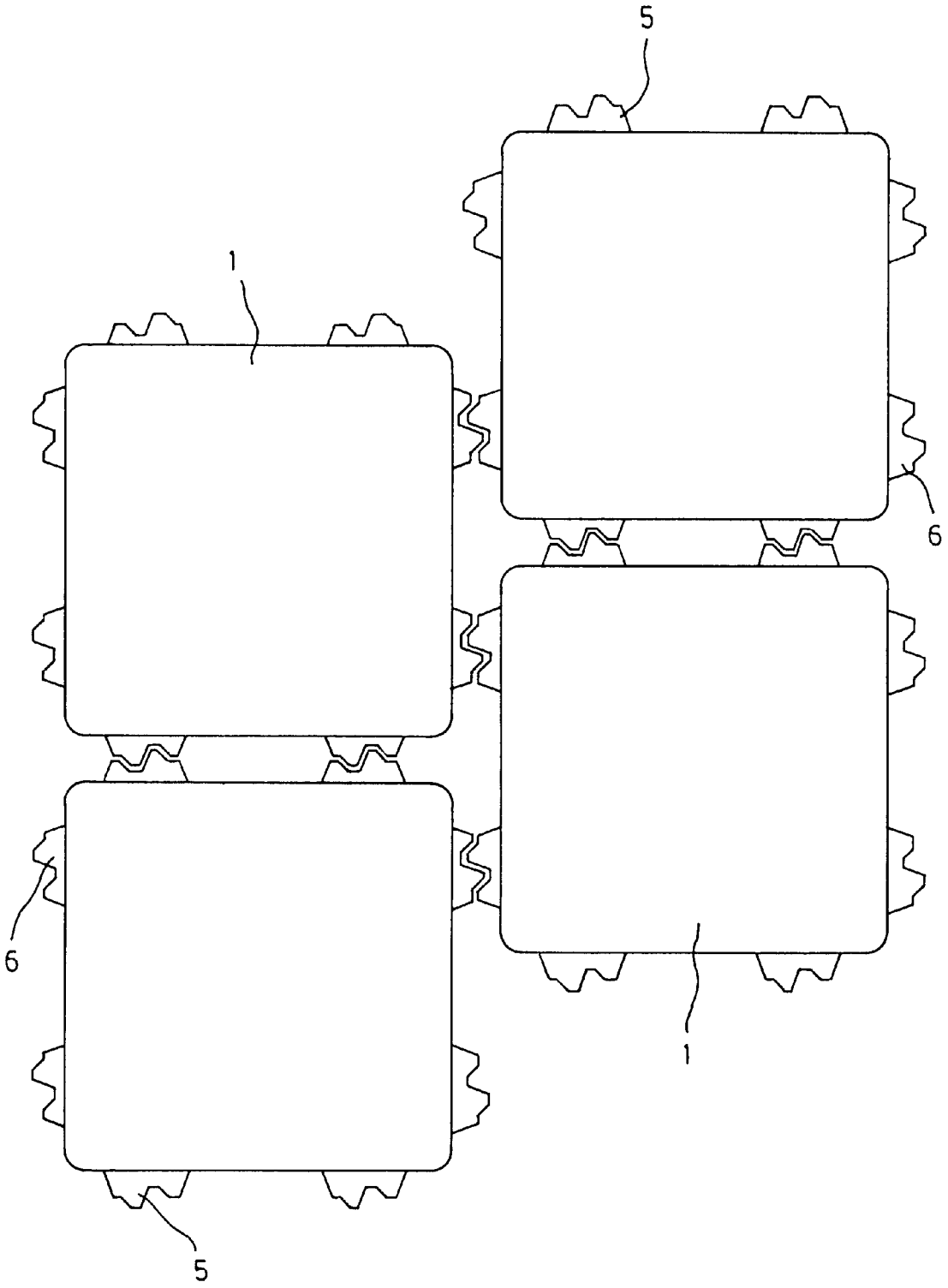
In FIG. 2 several stones laid adjacent one another in accordance with FIG. 1.

FIG. 2 shows several stones 1 laid adjacent one another. It can be seen that the stones can be laid not only in alignment but also offset with respect to one another, such that the distance of the offset is determined by the distance between adjacent spacer elements 5,6. It can be seen that the smaller the basic size unit 2 in accordance with FIG. 1, the smaller is the offset.

Figure 3:
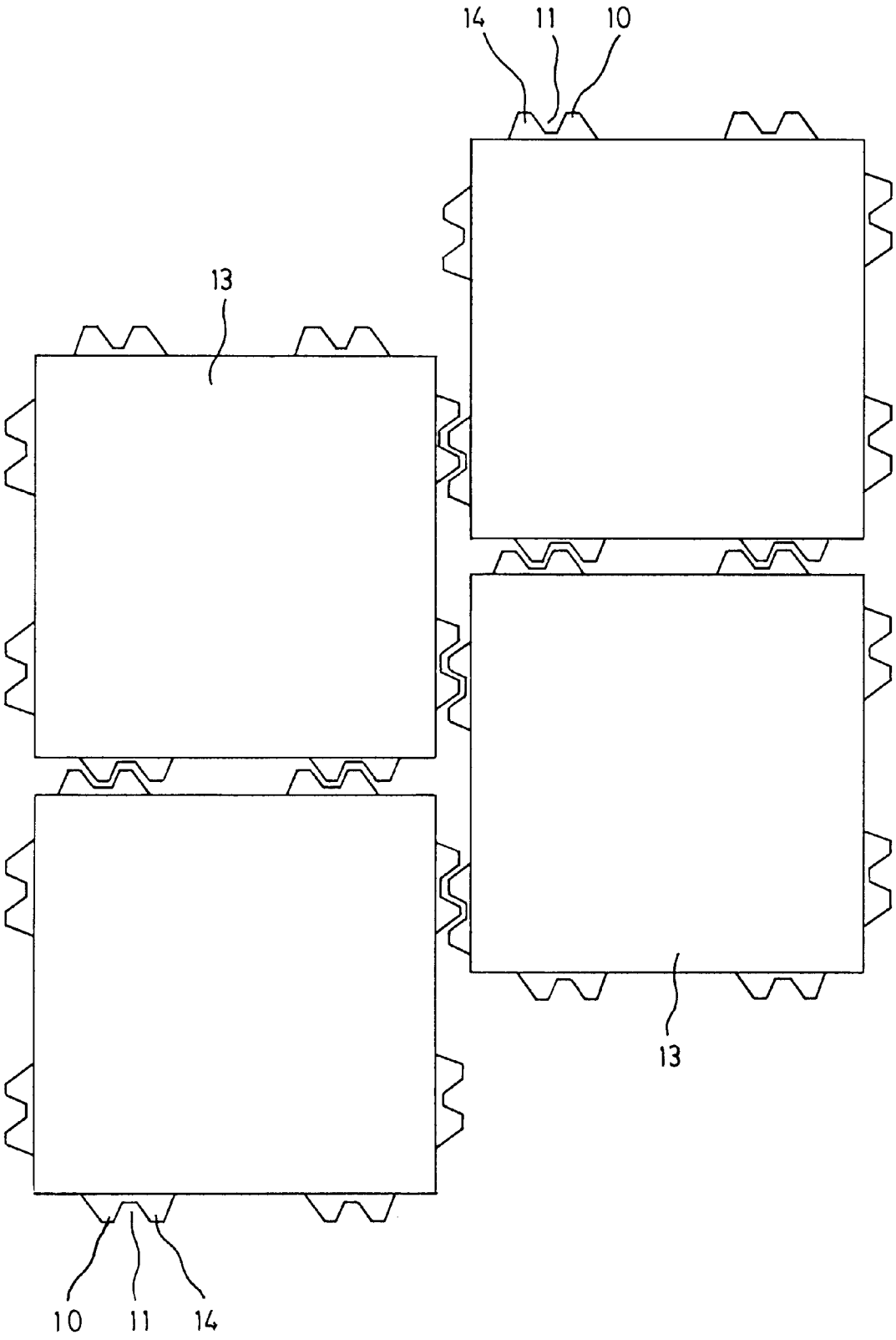
In FIGS. 3 and 4, stones laid in accordance with FIG. 2, however with an altered construction for the spacer elements.
Figure 4:
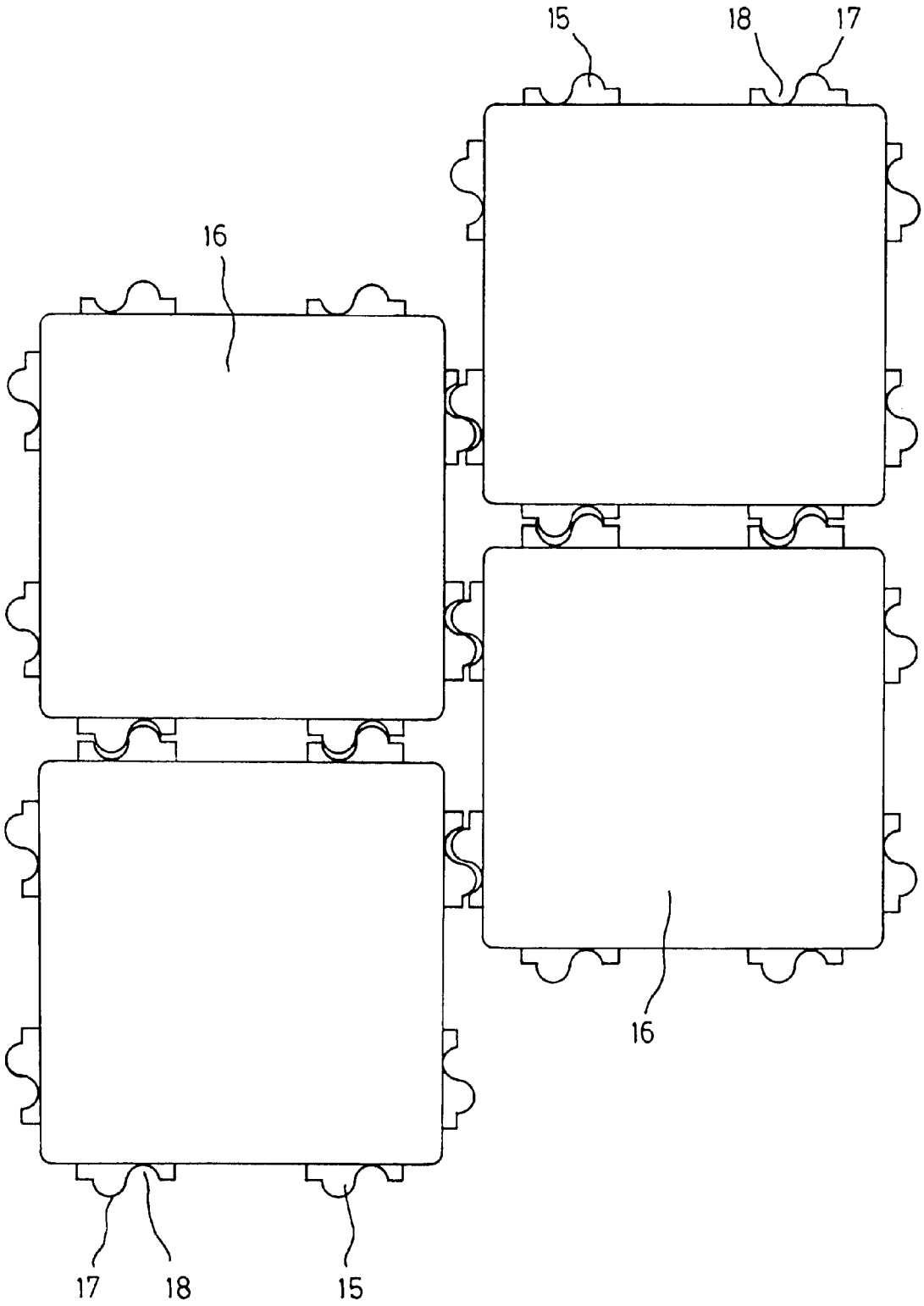

FIG. 3 shows stones 13 of the kind described in connection with FIG. 1. Here, however, the configuration of the spacer elements is altered so as to provide, on the side of the tooth recess 11 remote from the tooth 10, an enlargement 14 corresponding to the tooth 10, this construction having the effect of providing greater stability to the interlocking connection of adjacent stones, in the face of displacement forces applied to the stones.

In the embodiments illustrated in FIGS. 1, 2 and 3, the teeth 10 and the tooth recesses 11, including an enlargement 14, have essentially a trapezoidal cross-section with corresponding rectilinear flank directions. By contrast, the flanks of the teeth 17 and tooth recesses 18 of the spaced elements 15 of the stones 16, in accordance with FIG. 4, have a curvilinear construction adapted to fit complementarily together. As to the angles 40,41 mentioned with reference to FIG. 1, the same applies in FIG. 4 for the flank slope at the foot of the teeth 17 and the opening of the tooth recess 18.

Figure 5:
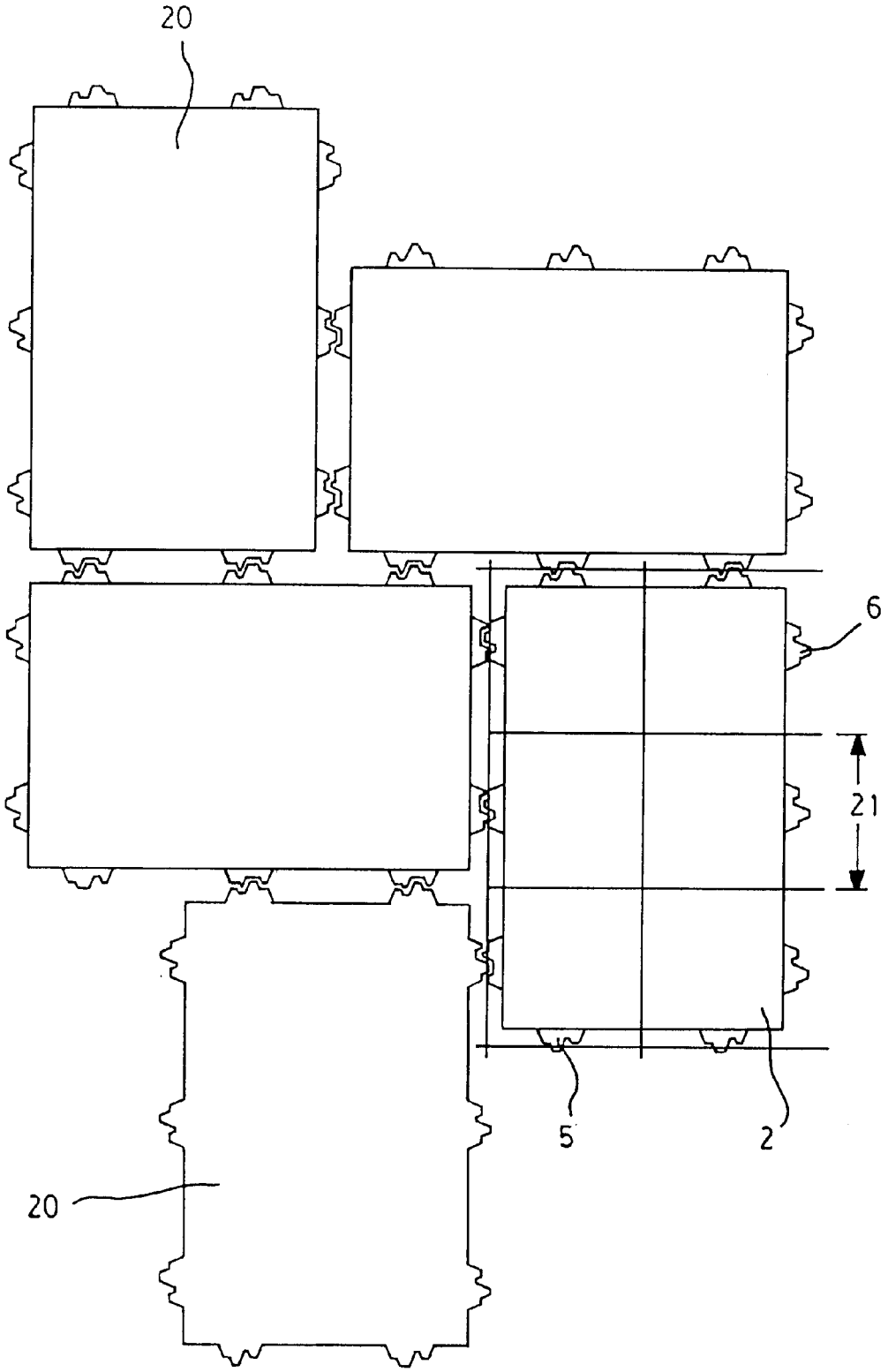
In FIG. 5, several elongated rectangular stones set in a herringbone pattern.

FIG. 5 shows elongated rectangular stones 20 set in a herringbone pattern, the latter being the sextuple of the basic size element 2. Accordingly, three spacer elements 6 are positioned adjacent one another along one edge of the stone, the result being that the effective edge length of the central basic size unit corresponds to the actual segment length 21 of the stone edge, because there are no spacer elements 5 on this length segment in the direction of the stone edge.

Figure 6:
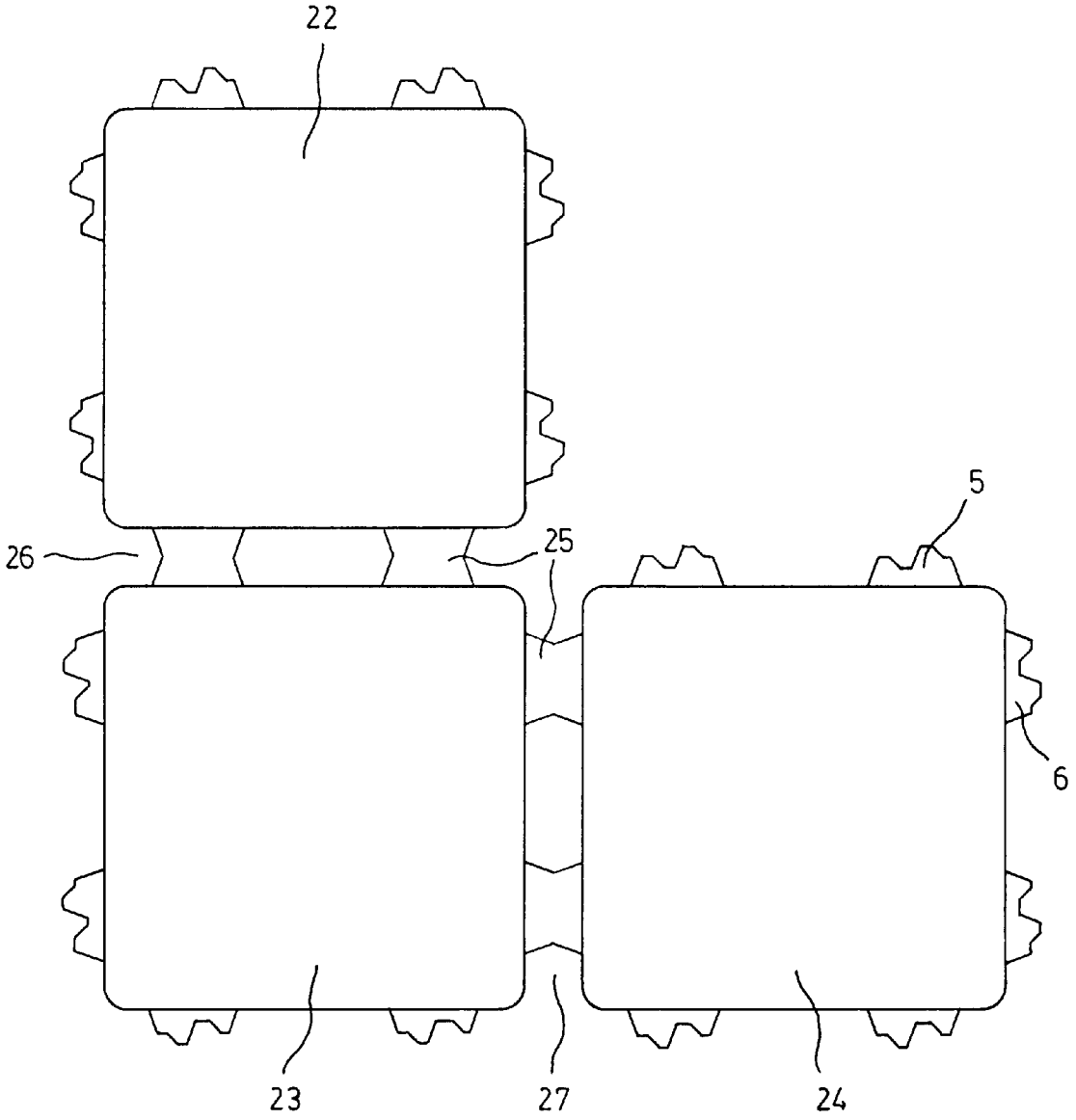
In FIG. 6, a modified stone shape having an L form.

FIG. 6 shows the possibility, for stones of the kind described in connection with FIG. 1, of joining a larger number of such stones to form a unitary laying unit, which in the present case is L-shaped. Three of such stone components 22,23,24 are connected to each other through bridges 25 located where normally the stones would abut each other through the intermediary of spacer elements 5,6; the structure can also be regarded as a unitary piece which is divided by channels 26,27, so that, after the laying of the unit with a single manipulation, there is the impression of three adjacently laid stones of the kind shown in FIG. 1. This embodiment makes possible a considerable saving of time during the laying procedure.

Figure 7:
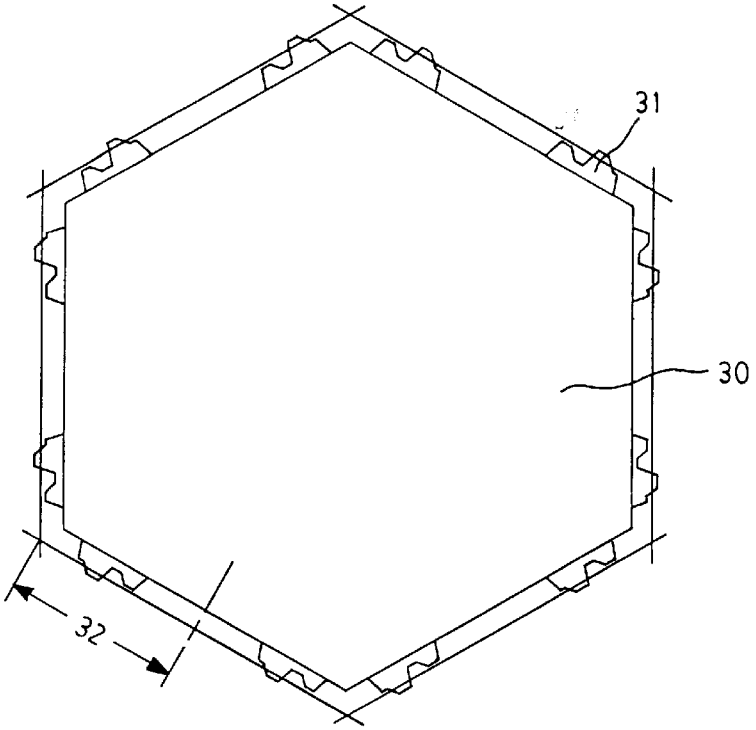
In FIG. 7, a hexagonal stone having a structure and an arrangement of spacer elements which are in accordance with the invention; and In FIG. 8, several adjacently laid stones of the kind shown in FIG. 7.

FIG. 7 shows a hexagonal stone 30 with edges of equal length and spacers 31 corresponding to the spacers 5 and 6 illustrated in FIG. 1. As to the size of the effective length 32 of the smallest edge surface length, the approach corresponds to the explanation already given in connection with FIG. 1, wherein the effective length 32 ends up being shorter as determined by the angle, which is different from 90 degrees, between adjacent edges of the stone 30. Also, the explanation set forth in connection with FIGS. 1–4 is valid for the configuration and positioning of the spacer elements 31.

Figure 8:
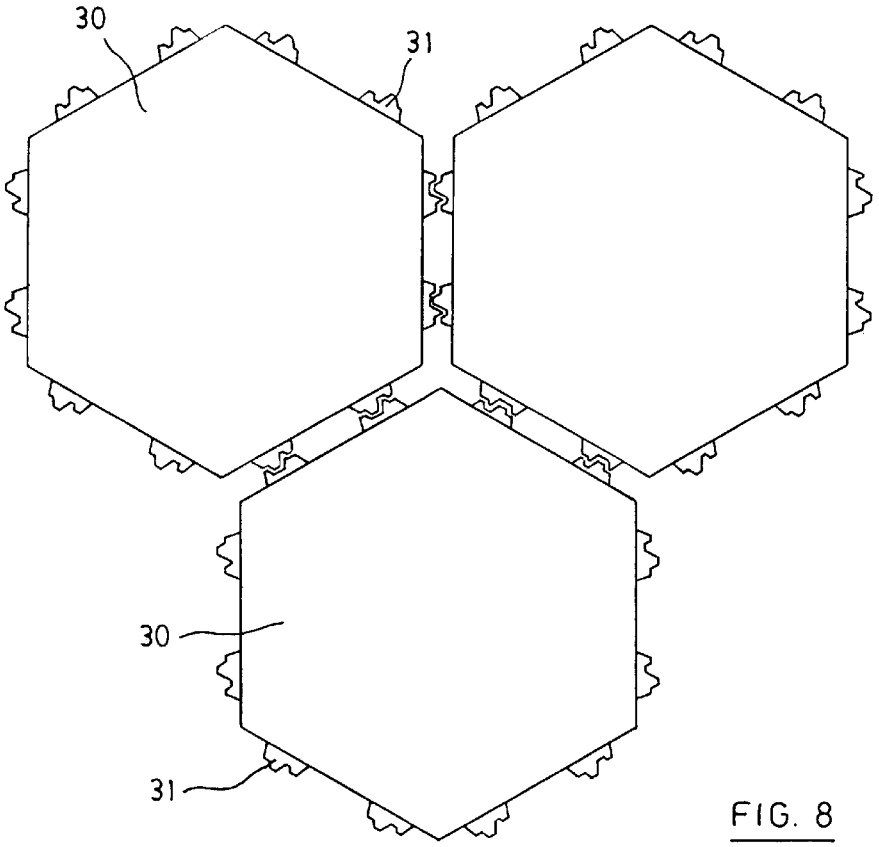

Finally, FIG. 8 shows several stones 30 in accordance with FIG. 7, laid adjacent one another. In this case as well, it would be possible again to replace the pairs of spacer elements located between the three stones with bridges corresponding to the embodiment shown in FIG. 6.

We claim:

1. An artificial concrete stone for strengthening of traffic-bearing surfaces in the open, in which said stone has integrally formed, comprising a plurality of completely identical spacer elements provided on edge surfaces of said stone, said edge surfaces being disposed perpendicularly to a laying plane and extending substantially parallel to one another; individual edge surface of said stone having a length, parallel to the laying plane, which is a whole number multiple of a smallest basic dimension; each segment of an edge surface element which has a length corresponding to the smallest basic dimension being provided with said spacer element; a central axis of said spacer element lying parallel to the laying plane and perpendicular to the corresponding edge surface and, being positioned in the middle of the corresponding edge surface segment; end surfaces of said spacer elements having, in the direction of said laying plane and of mutually facing edge surfaces, a tooth and a recessed contact surface for the tooth of the adjacently laid stone; said recessed contact surface corresponding to the size of said tooth of the adjacently laid stone and enclosing said tooth of the adjacently laid stone on both sides in the direction parallel to said laying plane; flanks of said tooth of the adjacently laid stone and of said recessed contact surface each enclosing an angle of at least 90 degrees with a bisector of said angle being essentially parallel to a line perpendicular to the corresponding edge surface; the sequence of said tooth and recess, in one peripheral direction of said stone, being the same for all spacer elements; wherein said spacers elements on the adjacent laid stones cooperate to provide wide grooves between the adjacently laid stones.

2. The artificial concrete stone according to claim 1, wherein said flanks of said tooth and of said tooth recess enclose said angle of 90 degrees.

3. The artificial concrete stone according to claim 2, wherein said flanks of said stone and of said tooth recess enclose said angle of 90 degrees.

4. The artificial concrete stone according to claim 2, wherein said flanks of said tooth and of said tooth recess have a contour different from a flat surface, and wherein the central slopes of said flanks enclose the angle of at least 90 degrees.

5. The artificial concrete stone according to claim 4, wherein said end surface of said tooth and said corresponding tooth recess of said spacer elements are trapezoidal in plan.

6. The artificial concrete stone according to claim 5, wherein said spacer elements lie below an upper surface of said stone which faces away from said laying plane.

7. The artificial concrete stone according to claim 6, wherein said stone has, parallel to said laying plane, a square, rectangular hexagonal L-shaped, Z-shaped, T-shaped or a double T-shaped cross section.

8. The artificial concrete stone according to claim 7, wherein said stone is divided by at least one wide channel, and wherein stone portions thus provided are securely connected to one another through common, solid bridges.

9. The artificial concrete stone according to claim 8, wherein said bridges, as regards to the distribution, of said bridges are configured correspondingly to said spacer elements.

10. The artificial concrete stone according to claim 9, wherein said stone portions are of different sizes.

11. The artificial concrete stone according to claim 10, said stone is connected together with other stones of the same or different size, to provide a laying unit.

12. The artificial concrete stone according to claim 4, wherein said end surface of said tooth and said corresponding tooth recess of said spacer elements are smoothly curved.

* * * * *